US008143508B2

(12) United States Patent
Jean et al.

(10) Patent No.: US 8,143,508 B2
(45) Date of Patent: Mar. 27, 2012

(54) SYSTEM FOR PROVIDING LYRICS WITH STREAMING MUSIC

(75) Inventors: Daniel George Jean, Atlanta, GA (US); Mary C. McCarthy, San Antonio, TX (US); Ledley Lewis Yaussy, Smyrna, GA (US)

(73) Assignee: AT&T Intellectual Property I, L.P., Atlanta, GA (US)

( * ) Notice: Subject to any disclaimer, the term of this patent is extended or adjusted under 35 U.S.C. 154(b) by 0 days.

(21) Appl. No.: 12/201,962

(22) Filed: Aug. 29, 2008

(65) Prior Publication Data

US 2010/0050853 A1 Mar. 4, 2010

(51) Int. Cl.
*G10H 1/00* (2006.01)

(52) U.S. Cl. ..... 84/600; 84/601; 84/610; 434/307 A

(58) Field of Classification Search ..... 84/600–602, 84/610; 434/307 A
See application file for complete search history.

(56) References Cited

U.S. PATENT DOCUMENTS

| | | | | |
|---|---|---|---|---|
| 5,214,792 | A | 5/1993 | Alwadish | |
| 5,408,686 | A | 4/1995 | Mankovitz | |
| 5,465,240 | A | 11/1995 | Mankovitz | |
| 5,526,284 | A | 6/1996 | Mankovitz | |
| 5,561,849 | A | 10/1996 | Mankovitz | |
| 6,062,867 | A * | 5/2000 | Torimura | 434/307 A |
| RE37,131 | E | 4/2001 | Mankovitz | |
| 6,433,266 | B1 * | 8/2002 | Fay et al. | 84/609 |
| 6,442,517 | B1 * | 8/2002 | Miller et al. | 704/201 |
| 6,931,198 | B1 * | 8/2005 | Hamada et al. | 386/46 |
| 7,181,636 | B2 * | 2/2007 | Kim et al. | 713/400 |
| 7,260,719 | B1 * | 8/2007 | Asano et al. | 713/169 |
| 7,444,353 | B1 * | 10/2008 | Chen et al. | 707/104.1 |
| 7,571,015 | B2 * | 8/2009 | Chan et al. | 700/94 |
| 2002/0193895 | A1 * | 12/2002 | Qian et al. | 700/94 |
| 2004/0249862 | A1 * | 12/2004 | Shin et al. | 707/104.1 |
| 2004/0266337 | A1 * | 12/2004 | Radcliffe et al. | 455/3.06 |
| 2005/0053362 | A1 * | 3/2005 | Manish | 386/96 |
| 2005/0077843 | A1 * | 4/2005 | Benditt | 315/312 |
| 2007/0123236 | A1 * | 5/2007 | Rey et al. | 455/414.4 |
| 2007/0166683 | A1 * | 7/2007 | Chang et al. | 434/307 R |
| 2007/0206929 | A1 * | 9/2007 | Konetski et al. | 386/96 |
| 2007/0282844 | A1 * | 12/2007 | Kim et al. | 707/10 |
| 2008/0050094 | A1 * | 2/2008 | Kim et al. | 386/95 |
| 2008/0059870 | A1 * | 3/2008 | Kim et al. | 715/203 |
| 2008/0097754 | A1 * | 4/2008 | Goto et al. | 704/214 |
| 2008/0115002 | A1 * | 5/2008 | Kim et al. | 713/400 |
| 2008/0274687 | A1 * | 11/2008 | Roberts et al. | 455/3.06 |
| 2009/0060458 | A1 * | 3/2009 | Bauchot et al. | 386/102 |
| 2009/0083281 | A1 * | 3/2009 | Sarig et al. | 707/10 |
| 2009/0105859 | A1 * | 4/2009 | Tagawa et al. | 700/94 |
| 2009/0120269 | A1 * | 5/2009 | Korst et al. | 84/609 |
| 2009/0132242 | A1 * | 5/2009 | Wang et al. | 704/216 |
| 2010/0003011 | A1 * | 1/2010 | Kim et al. | 386/96 |
| 2010/0003012 | A1 * | 1/2010 | Kim et al. | 386/96 |
| 2010/0003013 | A1 * | 1/2010 | Kim et al. | 386/96 |
| 2010/0005334 | A1 * | 1/2010 | Kim et al. | 713/400 |

* cited by examiner

*Primary Examiner* — David S. Warren
(74) *Attorney, Agent, or Firm* — Jackson Walker L.L.P.

(57) ABSTRACT

Methods and systems are disclosed for providing lyrics with streaming music. A music stream is accessed that includes timing information for a song. Lyrics and other textual information such as song title, song artist, and album title are also accessed. A lyric file may be accessed that includes further timing information. The timing information is used to synchronize the song lyrics and music stream. A user may be permitted access to the synchronized lyrics and music stream by presentation on a display through a digital television set-top box.

20 Claims, 3 Drawing Sheets

SYSTEM FOR PROVIDING LYRICS WITH STREAMING MUSIC

BACKGROUND

1. Field of the Disclosure

The present disclosure generally relates to multimedia content provider networks and more particularly to systems for providing lyrics with streaming music.

2. Description of the Related Art

Multimedia content provider networks may present users access to songs through streaming audio. Song lyrics are not provided to users that receive the streaming audio. Lyrics to songs are often provided with hard copies of songs, for example with liner notes included inside a compact disc jewel case.

DESCRIPTION OF THE EMBODIMENT(S)

Figure 1:
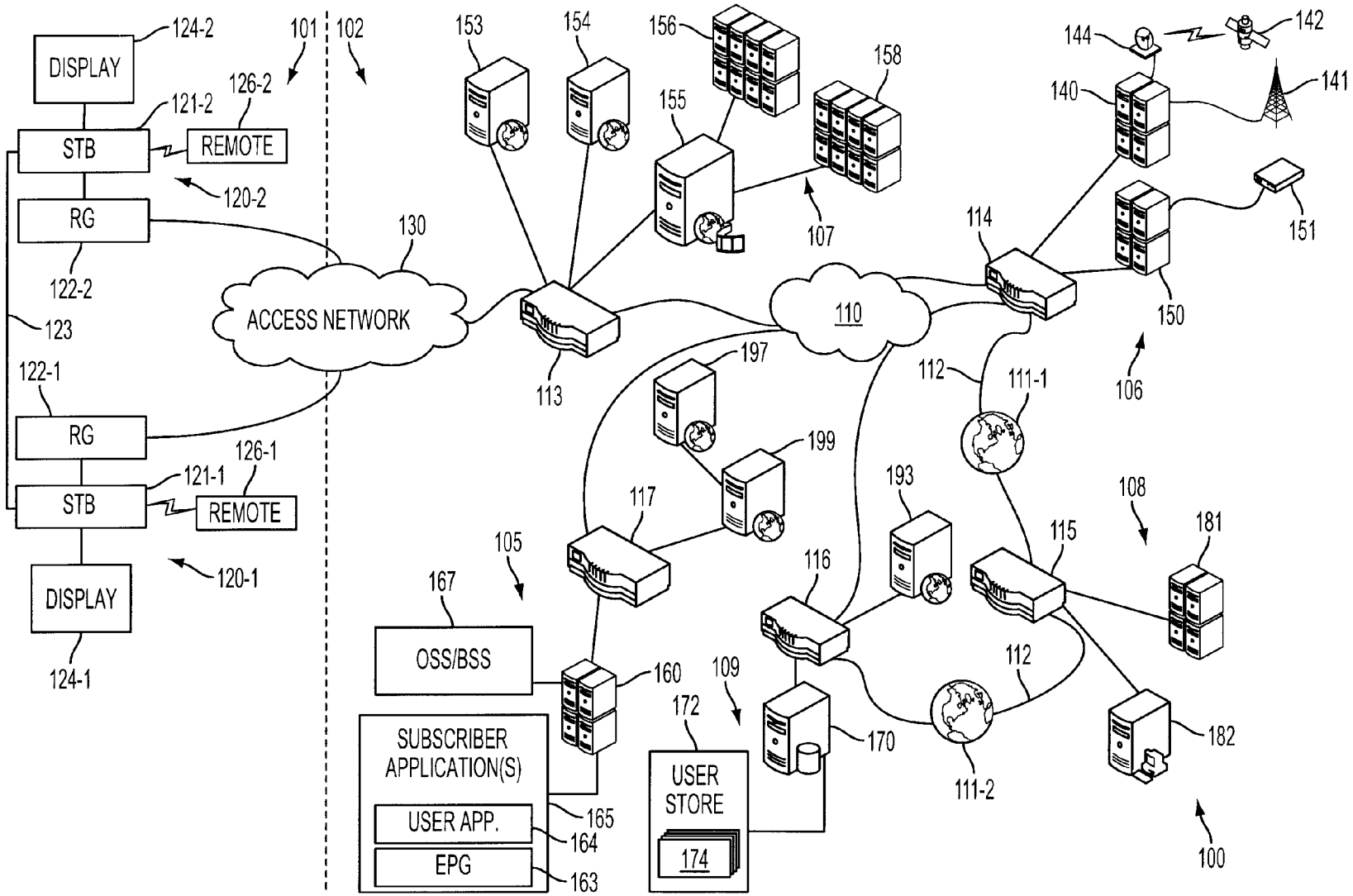
FIG. 1 illustrates a representative Internet Protocol Television (IPTV) architecture for providing lyrics with streaming music in accordance with disclosed embodiments.

In one aspect, a system for providing lyrics with streaming music includes a music server for accessing a music stream. The music stream includes timing information for a song. The system further includes a lyric server for accessing text information that includes lyrics to the song. The system further includes a synchronization server that uses the timing information to synchronize the lyrics with the music stream. The system further includes a network switch that permits user access to the synchronized plurality of words in the music stream. In some embodiments, the streaming music is received as an analog stream and the system further includes an encoder enabled for converting the analog stream into a bit stream. The encoder may further be enabled to compress the streaming multimedia content. The system may provide user access through a digital television set-top box (STB). The system may further include, in some embodiments, an encoder enabled for encapsulating the synchronized lyrics and the music stream into a series of Moving Picture Experts Group (MPEG) transport stream packets.

In another aspect, a disclosed computer program product is enabled for providing lyrics with streaming music. The computer program product has instructions stored on a computer readable media, for accessing a music stream that includes timing information for a song, for accessing a lyrics file for the song, for using the timing information to synchronize the lyrics with the music stream, and for delivering to a user the synchronized lyrics and music stream.

In some embodiments, the computer program product includes instructions for digitizing the analog stream into a bit stream. In some embodiments, permitting user access to the synchronized lyrics and music stream includes providing a digital STB with access to the synchronized lyrics and music stream. Some embodiments include instructions for encapsulating the lyrics and the music stream into packets. Any of these packets may include a plurality of MPEG transport stream packets. In some embodiments, encapsulating the lyrics and the music stream occurs at least partially at a real-time transport protocol layer. In some embodiments, the encapsulating occurs at least partially at a user datagram protocol layer.

In still another aspect, a disclosed method for providing song lyrics with streaming music includes accessing a music stream that includes a song and meta information for identifying the song, accessing a lyric file associated with the song, and presenting a user with an audio portion of the song and a visual depiction of the lyrics timed, using the timing information, to coincide with the audio portion of a song. In some embodiments, presenting the user with the audio portion of the song and the visual depiction of the lyrics occurs at least partially through a digital television STB. The method, in some embodiments, may include converting the analog stream into a bit stream if the streaming music is received as an analog stream. The method may further include encapsulating the music stream and the lyrics plurality into a series of MPEG transport stream packets. In some embodiments, encapsulating the music stream and the lyrics into a series of MPEG transport stream packets occurs at least partially at real-time transport protocol layer.

In the following description, examples are set forth with sufficient detail to enable one of ordinary skill in the art to practice the disclosed subject matter without undue experimentation. It should be apparent to a person of ordinary skill that the disclosed examples are not exhaustive of all possible embodiments. Regarding reference numerals used to describe elements in the figures, a hyphenated form of a reference numeral refers to a specific instance of an element and an un-hyphenated form of the reference numeral refers to the element generically or collectively. Thus, for example, element 121-1 refers to an instance of an STB, which may be referred to collectively as STBs 121 and any one of which may be referred to generically as an STB 121. Before describing other details of embodied methods and devices, selected aspects of multimedia content provider networks that provide multimedia programs are described to provide further context.

Television programs, video on-demand (VOD) movies, digital television content, music programming, and a variety of other types of multimedia content may be distributed to multiple users (e.g., subscribers) over various types of networks. Suitable types of networks that may be configured to support the provisioning of multimedia content services by a service provider include, as examples, telephony-based networks, coaxial-based networks, satellite-based networks, and the like.

In some networks including, for example, traditional coaxial-based "cable" networks, whether analog or digital, a service provider distributes a mixed signal that includes a large number of multimedia content channels (also referred to herein as "channels"), each occupying a different frequency band or frequency channel, through a coaxial cable, a fiber-optic cable, or a combination of the two. The bandwidth required to transport simultaneously a large number of multimedia channels may challenge the bandwidth capacity of cable-based networks. In these types of networks, a tuner within a STB, television, or other form of receiver is required to select a channel from the mixed signal for playing or recording. A user wishing to play or record multiple channels typically needs to have distinct tuners for each desired channel. This is an inherent limitation of cable networks and other mixed signal networks.

In contrast to mixed signal networks, IPTV networks generally distribute content to a user only in response to a user request so that, at any given time, the number of content channels being provided to a user is relatively small, e.g., one channel for each operating television plus possibly one or two channels for simultaneous recording. As suggested by the name, IPTV networks typically employ IP and other open, mature, and pervasive networking technologies to distribute multimedia content. Instead of being associated with a particular frequency band, an IPTV television program, movie, or other form of multimedia content is a packet-based stream that corresponds to a particular network endpoint, e.g., an IP address and a transport layer port number. In these networks, the concept of a channel is inherently distinct from the frequency channels native to mixed signal networks. Moreover, whereas a mixed signal network requires a hardware intensive tuner for every channel to be played, IPTV channels can be "tuned" simply by transmitting to a server an indication of a network endpoint that is associated with the desired channel.

IPTV may be implemented, at least in part, over existing infrastructure including, for example, a proprietary network that may include existing telephone lines, possibly in combination with customer premises equipment (CPE) including, for example, a digital subscriber line (DSL) modem in communication with an STB, a display, and other appropriate equipment to receive multimedia content and convert it into usable form. In some implementations, a core portion of an IPTV network is implemented with fiber optic cables while the so-called "last mile" may include conventional, unshielded, twisted-pair, copper cables.

IPTV networks support bidirectional (i.e., two-way) communication between a subscriber's CPE and a service provider's equipment. Bidirectional communication allows a service provider to deploy advanced features, such as VOD, pay-per-view, advanced programming information (e.g., sophisticated and customizable electronic programming guides (EPGs), and the like. Bidirectional networks may also enable a service provider to collect information related to a user's preferences, whether for purposes of providing preference based features to the user, providing potentially valuable information to service providers, or providing potentially lucrative information to content providers and others.

Referring now to the drawings, FIG. 1 illustrates selected aspects of a multimedia content distribution network (MCDN) 100 for providing music lyrics with streaming music in accordance with disclosed embodiments. MCDN 100, as shown, is a multimedia content provider network that may be generally divided into a client side 101 and a service provider side 102 (a.k.a. server side 102). Client side 101 includes all or most of the resources depicted to the left of access network 130 while server side 102 encompasses the remainder.

Client side 101 and server side 102 are linked by access network 130. In embodiments of MCDN 100 that leverage telephony hardware and infrastructure, access network 130 may include the "local loop" or "last mile," which refers to the physical cables that connect a subscriber's home or business to a local exchange. In these embodiments, the physical layer of access network 130 may include varying ratios of twisted pair copper cables and fiber optics cables. In a fiber to the curb (FTTC) access network, the last mile portion that employs copper is generally less than approximately 300 miles in length. In fiber to the home (FTTH) access networks, fiber optic cables extend all the way to the premises of the subscriber.

Access network 130 may include hardware and firmware to perform signal translation when access network 130 includes multiple types of physical media. For example, an access network that includes twisted-pair telephone lines to deliver multimedia content to consumers may utilize DSL. In embodiments of access network 130 that implement FTTC, a DSL access multiplexer (DSLAM) may be used within access network 130 to transfer signals containing multimedia content from optical fiber to copper wire for DSL delivery to consumers.

Access network 130 may transmit radio frequency (RF) signals over coaxial cables. In these embodiments, access network 130 may utilize quadrature amplitude modulation (QAM) equipment for downstream traffic. In these embodiments, access network 130 may receive upstream traffic from a consumer's location using quadrature phase shift keying (QPSK) modulated RF signals. In such embodiments, a cable modem termination system (CMTS) may be used to mediate between IP-based traffic on private network 110 and access network 130.

Services provided by the server side resources as shown in FIG. 1 may be distributed over a private network 110. In some embodiments, private network 110 is referred to as a "core network." In at least some embodiments, private network 110 includes a fiber optic wide area network (WAN), referred to herein as the fiber backbone, and one or more video hub offices (VHOs). In large-scale implementations of MCDN 100, which may cover a geographic region comparable, for example, to the region served by telephony-based broadband services, private network 110 includes a hierarchy of VHOs.

A national VHO, for example, may deliver national content feeds to several regional VHOs, each of which may include its own acquisition resources to acquire local content, such as the local affiliate of a national network, and to inject local content such as advertising and public service announcements from local entities. The regional VHOs may then deliver the local and national content to users served by the regional VHO. The hierarchical arrangement of VHOs, in addition to facilitating localized or regionalized content provisioning, may conserve bandwidth by limiting the content that is transmitted over the core network and injecting regional content "downstream" from the core network.

Segments of private network 110, as shown in FIG. 1, are connected together with a plurality of network switching and routing devices referred to simply as switches 113 through 117. The depicted switches include client facing switch 113, acquisition switch 114, operations-systems-support/business-systems-support (OSS/BSS) switch 115, database switch 116, and an application switch 117. In addition to providing routing/switching functionality, switches 113 through 117 preferably include hardware or firmware firewalls, not depicted, that maintain the security and privacy of network 110. Other portions of MCDN 100 may communicate over a public network 112, including, for example, Internet or other type of web-network where the public network 112 is signified in FIG. 1 by the World Wide Web icons 111.

As shown in FIG. 1, client side 101 of MCDN 100 depicts two of a potentially large number of client side resources referred to herein simply as client(s) 120. Each client 120, as shown, includes an STB 121, a residential gateway (RG) 122, a display 124, and a remote control device 126. In the depicted embodiment, STB 121 communicates with server side devices through access network 130 via RG 122.

As shown in FIG. 1, RG 122 may include elements of a broadband modem such as a DSL or cable modem, as well as elements of a firewall, router, and/or access point for an Ethernet or other suitable local area network (LAN) 123. In this embodiment, STB 121 is a uniquely addressable Ethernet compliant device. In some embodiments, display 124 may be any National Television System Committee (NTSC) and/or Phase Alternating Line (PAL) compliant display device. Both STB 121 and display 124 may include any form of conventional frequency tuner. Remote control device 126 communicates wirelessly with STB 121 using infrared (IR) or RF signaling. STB 121-1 and STB 121-2, as shown, may communicate through LAN 123 in accordance with disclosed embodiments to select multimedia programs for viewing.

In IPTV compliant implementations of MCDN 100, clients 120 are configured to receive packet-based multimedia streams from access network 130 and process the streams for presentation on displays 124. In addition, clients 120 are network-aware resources that may facilitate bidirectional-networked communications with server side 102 resources to support network hosted services and features. Because clients 120 are configured to process multimedia content streams while simultaneously supporting more traditional web-like communications, clients 120 may support or comply with a variety of different types of network protocols including streaming protocols such as real-time transport protocol (RTP) over user datagram protocol/internet protocol (UDP/IP) as well as web protocols such as hypertext transport protocol (HTTP) over transport control protocol (TCP/IP).

The server side 102 of MCDN 100 as depicted in FIG. 1 emphasizes network capabilities including application resources 105, which may have access to database resources 109, content acquisition resources 106, content delivery resources 107, and OSS/BSS resources 108.

Before distributing multimedia content to users, MCDN 100 first obtains multimedia content from content providers. To that end, acquisition resources 106 encompass various systems and devices to acquire multimedia content, reformat it when necessary, and process it for delivery to subscribers over private network 110 and access network 130.

Acquisition resources 106 may include, for example, systems for capturing analog and/or digital content feeds, either directly from a content provider or from a content aggregation facility. Content feeds transmitted via VHF/UHF broadcast signals may be captured by an antenna 141 and delivered to live acquisition server 140. Similarly, live acquisition server 140 may capture downlinked signals transmitted by a satellite 142 and received by a parabolic dish 144. In addition, live acquisition server 140 may acquire programming feeds transmitted via high-speed fiber feeds or other suitable transmission means. Acquisition resources 106 may further include signal conditioning systems and content preparation systems for encoding content.

As depicted in FIG. 1, content acquisition resources 106 include a VOD acquisition server 150. VOD acquisition server 150 receives content from one or more VOD sources that may be external to the MCDN 100 including, as examples, discs represented by a DVD player 151, or transmitted feeds (not shown). VOD acquisition server 150 may temporarily store multimedia content for transmission to a VOD delivery server 158 in communication with client-facing switch 113.

After acquiring multimedia content, acquisition resources 106 may transmit acquired content over private network 110, for example, to one or more servers in content delivery resources 107. As shown, live acquisition server 140 is communicatively coupled to an encoder which, prior to transmission, encodes acquired content using for example, MPEG-2, H.263, MPEG-4, H.264, a Windows Media Video (WMV) family codec, or another suitable video codec. The term "H.264" is an example standard for video compression. It may also be known by other terms such as "MPEG-4 Part 10", or "MPEG-4 AVC," in which "AVC" stands for "Advanced Video Coding." H.264 is a block-oriented, motion-estimation-based codec. H.264 is used for the compression of audio-visual (AV) data for streaming media, web distribution, voice applications, videophone applications, multimedia content distribution, and the like. Reference herein to H.264 is for illustration purposes and is not meant to limit the disclosed subject matter.

Content delivery resources 107, as shown in FIG. 1, are in communication with private network 110 via client facing switch 113. In the depicted implementation, content delivery resources 107 include a content delivery server 155 in communication with a live or real-time content server 156 and a VOD delivery server 158. For purposes of this disclosure, the use of the term "live" or "real-time" in connection with content server 156 is intended primarily to distinguish the applicable content from the content provided by VOD delivery server 158. The content provided by a VOD server is sometimes referred to as time-shifted content to emphasize the ability to obtain and view VOD content substantially without regard to the time of day or the day of week.

Content delivery server 155, in conjunction with live content server 156 and VOD delivery server 158, responds to user requests for content by providing the requested content to the user. The content delivery resources 107 are, in some embodiments, responsible for creating video streams that are suitable for transmission over private network 110 and/or access network 130. In some embodiments, creating video streams from the stored content generally includes generating data packets by encapsulating relatively small segments of the stored content according to the network communication protocol stack in use. These data packets are then transmitted across a network to a receiver (e.g., STB 121 of client 120), where the content is parsed from individual packets and reassembled into multimedia content suitable for processing by a decoder.

User requests received by content delivery server 155 may include an indication of the content that is being requested. In some embodiments, this indication includes a network endpoint associated with the desired content. The network endpoint may include an IP address and a transport layer port number. For example, a particular local broadcast television station may be associated with a particular channel and the feed for that channel may be associated with a particular IP address and transport layer port number. When a user wishes to view the station, the user may interact with remote control device 126 to send a signal to STB 121 indicating a request for the particular channel. When STB 121 responds to the remote control signal, the STB 121 changes to the requested channel by transmitting a request that includes an indication of the network endpoint associated with the desired channel to content delivery server 155.

Content delivery server 155 may respond to such requests by making a streaming video or audio signal accessible to the user. Content delivery server 155 may employ a multicast protocol to deliver a single originating stream to multiple clients. When a new user requests the content associated with a multicast stream, there may be latency associated with updating the multicast information to reflect the new user as a part of the multicast group. To avoid exposing this undesirable latency to a user, content delivery server 155 may temporarily unicast a stream to the requesting user. When the user is ultimately enrolled in the multicast group, the unicast stream is terminated and the user receives the multicast stream. Multicasting desirably reduces bandwidth consumption by reducing the number of streams that must be transmitted over the access network 130 to clients 120.

As illustrated in FIG. 1, a client-facing switch 113 provides a conduit between client side 101, including client 120, and server side 102. Client-facing switch 113, as shown, is so-named because it connects directly to the client 120 via access network 130 and it provides the network connectivity of IPTV services to users' locations. To deliver multimedia content, client-facing switch 113 may employ any of various existing or future Internet protocols for providing reliable real-time streaming multimedia content. In addition to the TCP, UDP, and HTTP protocols referenced above, such protocols may use, in various combinations, other protocols including, RTP, real-time control protocol (RTCP), file transfer protocol (FTP), and real-time streaming protocol (RTSP), as examples.

In some embodiments, client-facing switch 113 routes multimedia content encapsulated into IP packets over access network 130. For example, an MPEG-2 transport stream may be sent, in which the transport stream consists of a series of 188-byte transport packets. The MPEG-2 transport stream may include video and audio portions of a song with lyrics for a presentation on a user's display, which may receive one or more signals from a digital television STB, in accordance with disclosed embodiments. Client-facing switch 113, as shown, is coupled to a content delivery server 155, acquisition switch 114, applications switch 117, a client gateway 153, and a terminal server 154 that is operable to provide terminal devices with a connection point to the private network 110. Client gateway 153 may provide subscriber access to private network 110 and the resources coupled thereto.

In some embodiments, STB 121 may access MCDN 100 using information received from client gateway 153. Subscriber devices may access client gateway 153 and client gateway 153 may then allow such devices to access the private network 110 once the devices are authenticated or verified. Similarly, client gateway 153 may prevent unauthorized devices, such as hacker computers or stolen STBs, from accessing the private network 110. Accordingly, in some embodiments, when an STB 121 accesses MCDN 100, client gateway 153 verifies subscriber information by communicating with user store 172 via the private network 110. Client gateway 153 may verify billing information and subscriber status by communicating with an OSS/BSS gateway 167. OSS/BSS gateway 167 may transmit a query to the OSS/BSS server 181 via an OSS/BSS switch 115 that may be connected to a public network 112. Upon client gateway 153 confirming subscriber and/or billing information, client gateway 153 may allow STB 121 access to IPTV content, VOD content, and other services. If client gateway 153 cannot verify subscriber information (i.e., user information) for STB 121, for example, because it is connected to an unauthorized local loop or RG, client gateway 153 may block transmissions to and from STB 121 beyond the private access network 130.

MCDN 100, as depicted, includes application resources 105, which communicate with private network 110 via application switch 117. Application resources 105 as shown include an application server 160 operable to host or otherwise facilitate one or more subscriber applications 165 that may be made available to system subscribers. For example, subscriber applications 165 as shown include an EPG application 163. Subscriber applications 165 may include other applications as well. In addition to subscriber applications 165, application server 160 may host or provide a gateway to operation support systems and/or business support systems. In some embodiments, communication between application server 160 and the applications that it hosts and/or communication between application server 160 and client 120 may be via a conventional web based protocol stack such as HTTP over TCP/IP or HTTP over UDP/IP.

Application server 160 as shown also hosts an application referred to generically as user application 164. User application 164 represents an application that may deliver a value added feature to a user, who may be a subscriber to a service provided by MCDN 100. For example, in accordance with disclosed embodiments, user application 164 may be an application that provides a user with one or more selectable audio tracks and lyrics to be received and played in synchronized form through an STB by audio and video equipment. User application 164, as illustrated in FIG. 1, emphasizes the ability to extend the network's capabilities by implementing a network-hosted application. Because the application resides on the network, it generally does not impose any significant requirements or imply any substantial modifications to client 120 including STB 121. In some instances, an STB 121 may require knowledge of a network address associated with user application 164, but STB 121 and the other components of client 120 are largely unaffected.

As shown in FIG. 1, a database switch 116 as connected to applications switch 117 provides access to database resources 109. Database resources 109 include a database server 170 that manages a system storage resource 172, also referred to herein as user store 172. User store 172, as shown, includes one or more user profiles 174 where each user profile includes account information and may include preferences information that may be retrieved by applications executing on application server 160 including user applications 165.

As shown, MCDN 100 includes synchronization server 199, lyric server 197, and music server 193. Music server 193, in accordance with disclosed embodiments, provides MCDN 100 access to a music stream through one or more potential sources including the Internet, live acquisition resources, compact disc recordings, and the like. Lyric server 197, in accordance with disclosed embodiments, provides MCDN 100 with access to textual information including lyrics, song titles, artists, and album titles, as examples. Lyric server 197 may pull such textual information from external sources and store the information internally within MCDN 100. In accordance with disclosed embodiments, synchronization server 199 synchronizes song lyrics with streaming music using timing information that may be included within metadata received with streaming music. In addition, lyrics files may include timing information for a song to permit synchronization of the lyrics with the streaming music. Switch 117 permits access to the synchronized lyrics and music stream to STB 121-2, for example.

In some embodiments, music server 193 receives streaming music as an analog stream and synchronization server 199, music server 193, or other components within MCDN 100 act as an encoder for digitizing the analog stream, i.e., converting or otherwise processing the analog stream into a bit stream. In addition to digitizing the analog stream, music server 193 may compress and encrypt the bit stream. Music server 193 may also be configured to encapsulate the song lyrics and music stream into a series of MPEG transport stream packets. In some embodiments, encapsulating the lyrics and music stream into a series of MPEG transport stream packets occurs at least partially at a real-time transport protocol layer. In addition, encapsulating the song lyrics and music stream into an MPEG transport stream may occur at least partially at a user datagram protocol layer.

Figure 2:
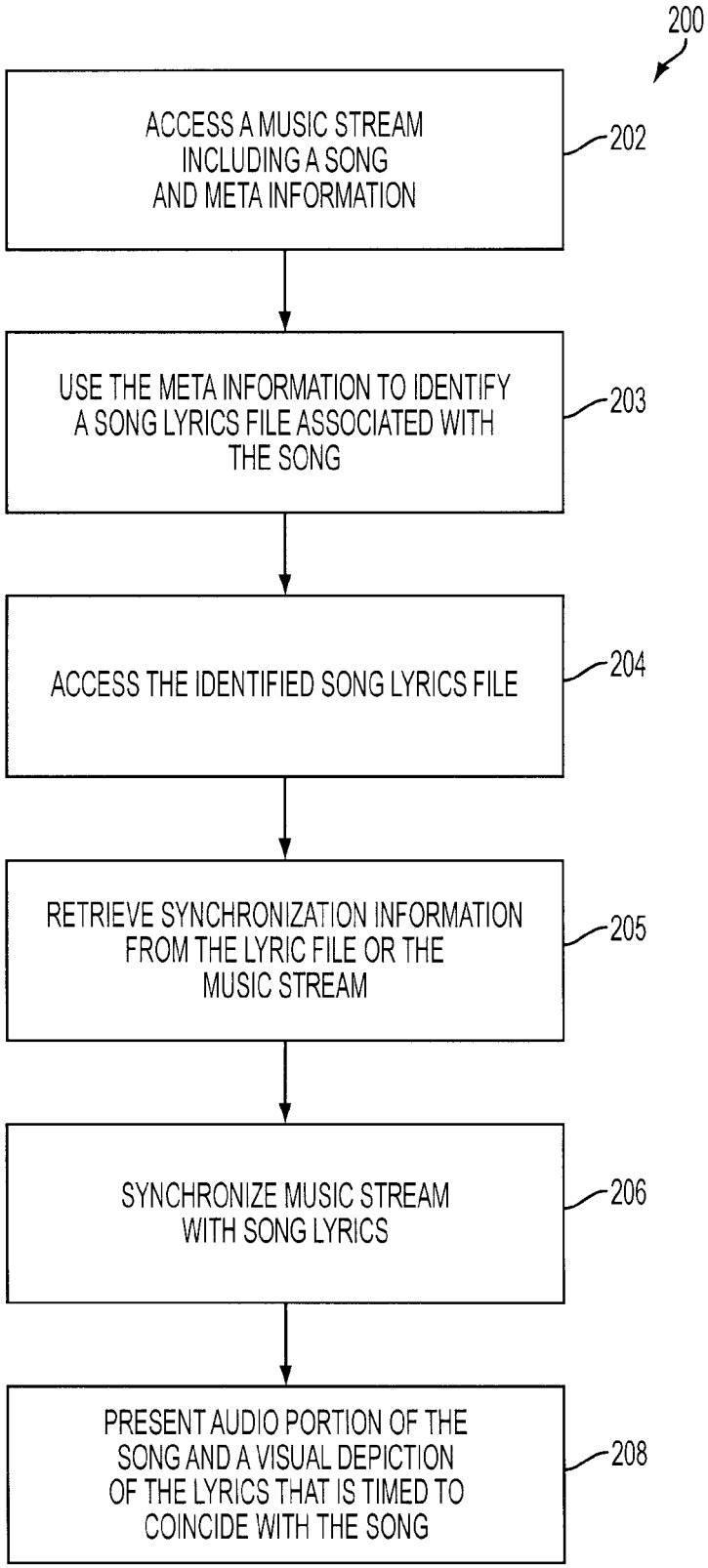
FIG. 2 illustrates selected operations in a methodology for providing lyrics with streaming music in accordance with disclosed embodiments.

FIG. 2 depicts selected operations of an embodiment of a method 200 for providing song lyrics with streaming music. As shown, method 200 includes accessing (operation 202) a music stream that includes a song and meta information for the song. The meta information is used (operation 203) to identify a song lyrics file associated with the song. The identified song lyrics are accessed (operation 204). The music stream may be an Internet music cast, a simulcast of a radio station, or another type of real time broadcast of music content. Song lyrics may reside internally within a multi-media content distribution network (e.g., MCDN 100, FIG. 1) or may be accessed in real time from external sources such as the Internet or from music production companies, as examples.

The music stream accessed in operation 202 may be from compact discs, streaming radio sources on the Internet, live acquisition resources obtained from satellite broadcasts, or live radio received from over-the-air broadcasts, as examples. The accessed music stream may include timing information, or timing information may be added within a multimedia content provider network to allow for synchronization with song lyrics, in accordance with disclosed embodiments.

As depicted in FIG. 2, method 200 includes retrieving synchronization information (operation 205) from the lyric file or the music stream. Method 200 also includes synchronizing (operation 206) the music stream with lyrics in the lyric file. In some embodiments, synchronized song lyrics are displayed on a user's television screen. As a user listens to the audio portion of a song, song lyrics which coincide to the audio portion may be displayed to allow the user to read or sing along with the audio portion. As shown, method 200 further includes presenting (operation 208) the audio portion of the song and a visual depiction of the lyrics that is timed to coincide with the song.

Figure 3:
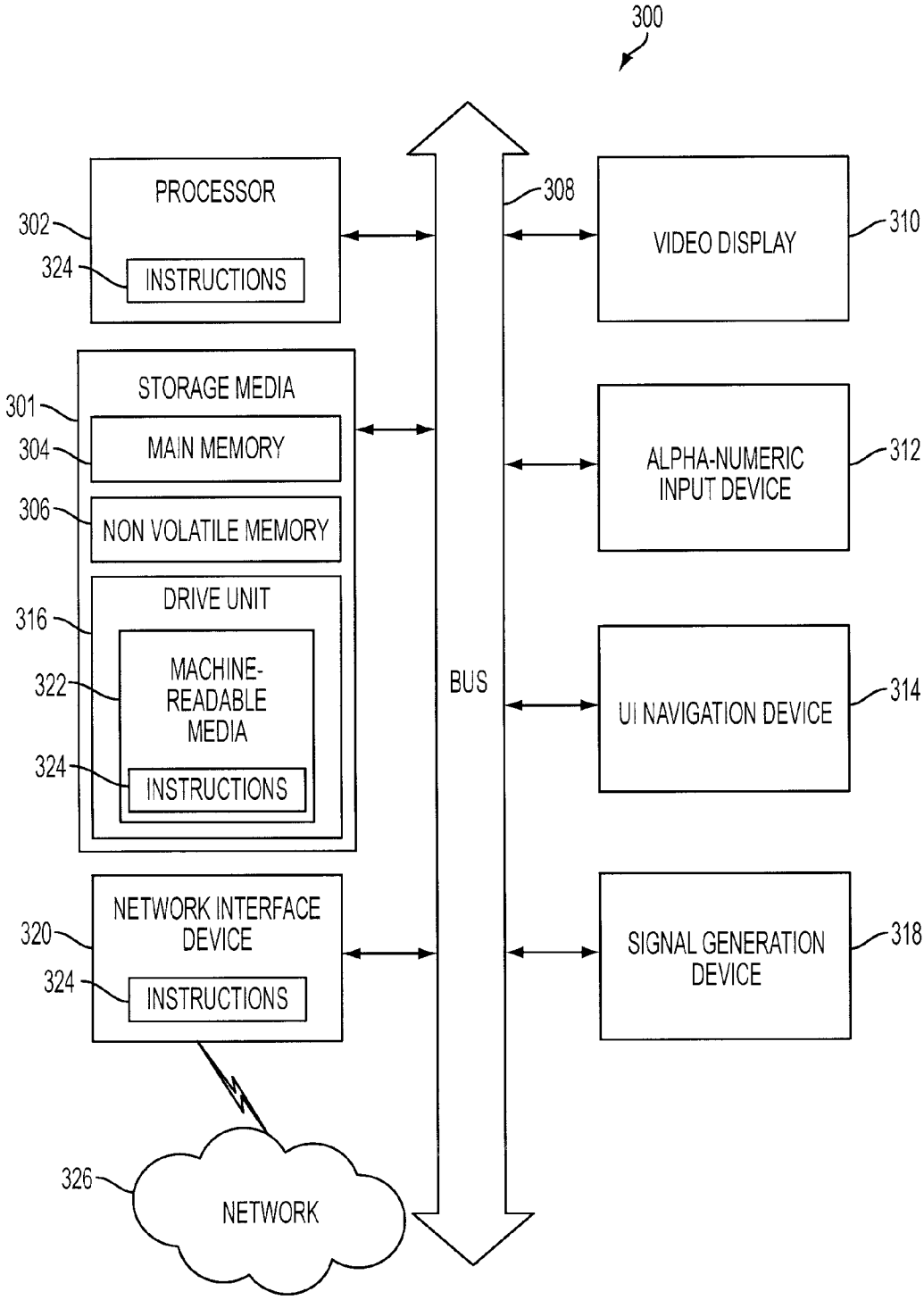
FIG. 3 illustrates a data processing system for use with disclosed embodiments to provide lyrics with streaming music.

FIG. 3 illustrates, in block diagram form, selected elements of an embodiment of a data processing system 300 within which a set of instructions may operate to perform one or more of the methodologies discussed herein. Data processing system 300 may operate as a standalone device or may be connected (e.g., networked) to other data processing systems. In a networked deployment, data processing system 300 may operate in the capacity of a server or a client data processing system in a server-client network environment, or as a peer computer in a peer-to-peer (or distributed) network environment. Example data processing systems include, but are not limited to, an encoder, a digital video recorder, a personal computer (PC), a tablet PC, an STB, a cable box, a satellite box, an EPG box, a personal data assistant, a cellular telephone, a smart phone, a web appliance, a network router, a switch, a bridge, a server, or any machine capable of executing a set of instructions (sequential or otherwise) that specify actions to be taken by that machine. Further, while only a single data processing system is illustrated, the term "data processing system" shall also be taken to include any collection of data processing systems that individually or jointly execute a set (or multiple sets) of instructions to perform any one or more of the methodologies discussed herein.

As shown in FIG. 3, data processing system 300 includes a processor 302 (e.g., a central processing unit, a graphics processing unit, or both) and storage media 301 that includes a main memory 304 and a non-volatile memory 306, and a disc drive unit 316 that may communicate with each other via a bus 308. In some embodiments, the main memory 304 and/or the non-volatile memory 306 may be used to store the indicators or values that relate to multimedia content accessed or requested by a consumer. Data processing system 300 may further include a video display unit 310 (e.g., a television, a liquid crystal display or a cathode ray tube) on which to display multimedia content such as the presentation of textual information (e.g., song lyrics) for a song, pay-per-view sporting events, television programs, VOD movies, and the like. Data processing system 300 also includes an alphanumeric input device 312 (e.g., a keyboard), a user interface (UI) navigation device 314 (e.g., a remote control or a mouse), a signal generation device 318 (e.g., a speaker) and a network interface device 320. The input device 312 and/or the UI navigation device 314 (e.g., the remote control) may include a processor (not shown), and a memory (not shown). The disk drive unit 316 includes a magnetic or solid state machine-readable medium 322 that may have stored thereon one or more sets of instructions 324 and data structures not depicted embodying or utilized by any one or more of the methodologies or functions described herein. The instructions 324 may also reside, completely or at least partially, within the main memory 304, within non-volatile memory 306, within network interface device 320, and/or within the processor 302 during execution thereof by the data processing system 300.

The instructions 324 may be transmitted or received over a network 326 (e.g., a multimedia content provider) via the network interface device 320 utilizing any one of a number of transfer protocols (e.g., broadcast transmissions, HTTP). While the machine-readable medium 322 is depicted as a single medium, the term "machine-readable medium" should be taken to include a single medium or multiple media (e.g., a centralized or distributed database, and/or associated caches and servers) that store the one or more sets of instructions. The term "machine-readable medium" shall also be taken to include any medium that is capable of storing, encoding or carrying a set of instructions for execution by the machine (i.e., data processing system) and that cause the machine to perform any one or more of the methodologies of the present invention, or that is capable of storing, encoding, or carrying data structures utilized by or associated with such a set of instructions. The term "machine-readable medium" shall accordingly be taken to include, but not be limited to, solid-state memories, optical and magnetic media.

In accordance with some embodiments, instructions 324 are stored on at least one computer readable media and enable data processing system 300 to provide song lyrics with streaming music. Accordingly, in some embodiments, instructions 324 enable data processing system 300 to access a music stream that includes meta information for a song, to access a lyrics file for the song that includes timing information to use the timing information to synchronize the lyrics with the music stream, and to permit user access to the synchronized lyrics and music stream. In some embodiments, instructions 324 include instructions to digitize an analog stream containing the streaming music into a bit stream and compress the bit stream. Instructions 324 may also include instructions to permit a user access to the synchronized lyrics and music stream by encoding the synchronized lyrics and music stream for use by a digital television STB and encapsulating the lyrics and the music stream. In some embodiments, individual packets of a plurality of packets include a plurality of MPEG transport stream packets. Encapsulating the plurality of packets may occur at least partially at a real-time transport protocol layer or at a user datagram protocol layer.

While the disclosed subject matter has been described in connection with one or more embodiments, the disclosed embodiments are not intended to limit the subject matter of the claims to the particular forms set forth. On the contrary, disclosed embodiments are intended to encompass alternatives, modifications and equivalents.

What is claimed is:

1. A system for providing content to an end user via a provider network, the system comprising:

a processor having access to a storage medium, the storage medium including program instructions, executable by the processor, the program instructions including instructions for:

accessing a music stream corresponding to a song, wherein the music stream includes meta information identifying a song lyrics file residing on a server accessible via an external network;

accessing the song lyrics file, wherein the song lyrics file includes song lyrics;

processing the song lyrics file and the music stream to generate multimedia content, the multimedia content including an audio portion for the song and a video portion for the lyrics, wherein the song and the lyrics are synchronized; and sending the multimedia content to a customer premises device over the provider network.

2. The system of claim 1, wherein the song lyrics file is a text file and wherein processing the song lyrics file comprises generating a video stream indicative of the song lyrics.

3. The system of claim 2, wherein the provider network is a private network including a core network of the provider and an access network linking the customer premises device and the core network and wherein the external network is a public network.

4. The system of claim 3, wherein the public network includes the Internet.

5. The system of claim 1, further comprising:

an encoder for packetizing the multimedia content into a series of MPEG transport stream packets.

6. The system of claim 5, wherein the packetizing occurs at least partially at a user datagram protocol layer of a network communication protocol.

7. The system of claim 5, wherein the packetizing occurs at least partially at a real time protocol layer of a network communication protocol.

8. A computer program product comprising program instructions, stored on computer readable media, for providing music via a provider network, the program instructions including instructions for:

accessing a music stream for a song;

identifying a song lyrics file accessible via an external network from meta information included in the music stream;

accessing the song lyrics file on the external network wherein the song lyrics file includes lyrics for the song;

processing the song lyrics file and the music stream to generate multimedia content including an audio portion corresponding to the song and a synchronized video portion corresponding to the lyrics; and delivering the multimedia content to a customer premises device over the provider network.

9. The computer program product of claim 8, wherein the music stream is received as an analog stream, wherein the program instructions include instructions for:

digitizing the analog stream into a bit stream.

10. The computer program product of claim 9, wherein the program instructions include instructions for:

compressing the bit stream.

11. The computer program product of claim 8, wherein the instructions for delivering the multimedia content include instructions for delivering the multimedia content to a digital television set-top box.

12. The computer program product of claim 11, wherein the program instructions include instructions for:

processing the multimedia content into a plurality of packets.

13. The computer program product of claim 12, wherein the plurality of packets include a plurality of MPEG transport stream packets.

14. The computer program product of claim 12, wherein processing the multimedia content occurs at least partially at a real-time transport protocol layer of a network communication protocol.

15. The computer program product of claim 12, wherein processing the multimedia content occurs at least partially at a user datagram protocol layer of a network communication protocol.

16. A method for providing song lyrics with streaming music via a provider network, the method comprising:

accessing, via a music server, a music stream that includes audio data for a song and meta information identifying a song lyric file residing on a lyrics server accessible via an external network, wherein the song lyric file includes lyrics for the song;

accessing the song lyric file on the lyrics server via the external network;

processing the song lyrics file and the music stream to generate multimedia content including an audio portion for the song and a video portion for the lyrics, synchronized with the audio portion; and sending the multimedia content to a customer premises equipment device via the provider network.

17. The method of claim 16, wherein:

processing the song lyrics file includes generating a video encoding of the lyrics.

18. The method of claim 17, wherein:

generating the video encoding of the lyrics includes generating an MPEG-2 encoding of the lyrics.

19. The method of claim 16, further comprising encapsulating the multimedia content into a series of MPEG transport stream packets.

20. The method of claim 19, wherein the encapsulating occurs at least partially at one of a real-time transport protocol layer and a user datagram protocol layer of a network communication protocol.

* * * * *